US005361558A

United States Patent [19]

Thornton et al.

[11] Patent Number: 5,361,558

[45] Date of Patent: Nov. 8, 1994

[54] ROOF MOUNTABLE SAFETY LINE ANCHOR

[76] Inventors: Stacy Thornton, 419 N. 6th, Tumwater, Wash. 98512; Jon McCown, 2535 70th Ave. SW., Space #2, Tumwater, Wash. 98512

[21] Appl. No.: 989,216

[22] Filed: Dec. 11, 1992

[51] Int. Cl.[5] ..... A47G 29/02

[52] U.S. Cl. ..... 52/698; 52/27; 52/37; 52/745.21; 52/749; 182/3; 182/45; 248/237

[58] Field of Search ..... 52/698, 749, DIG. 1, 52/27, 57, 712, 715, 37, 745.21; 248/237, 499, 536, 220.1; 182/45, 3

[56] References Cited

U.S. PATENT DOCUMENTS

| | | | |
|---|---|---|---|
| 1,470,489 | 10/1923 | Schuh . | |
| 2,474,920 | 7/1949 | Stearns | 248/499 |
| 2,575,254 | 11/1951 | Blaugrund . | |
| 2,703,688 | 3/1955 | Shuter | 248/237 |
| 3,184,800 | 5/1965 | Nelson . | |
| 3,237,717 | 3/1966 | Jackson . | |
| 3,292,734 | 12/1966 | Swanberg . | |
| 3,481,635 | 12/1969 | Tracy . | |
| 3,606,226 | 9/1971 | Bell, Sr. . | |
| 4,249,713 | 2/1981 | Glynn et al. . | |
| 5,011,106 | 4/1991 | Cody . | |
| 5,054,576 | 10/1991 | Glynn . | |

FOREIGN PATENT DOCUMENTS

| | | | |
|---|---|---|---|
| 2440508 | 7/1980 | France | 52/712 |
| 2847275 | 5/1980 | Germany | 248/237 |

*Primary Examiner*—Carl D. Friedman
*Assistant Examiner*—Christopher Todd Kent
*Attorney, Agent, or Firm*—Glenn D. Bellamy; Teresa J. Wiant

[57] ABSTRACT

A safety line anchor (20) is installed on a peaked roof (12) to provide safety line connection points (36) for a worker (10) working on or near the roof. When installed, a first leg (24) and a second leg (26) of the safety line anchor (20) extend down either side of the peaked roof (12). The anchor (20) is installed by use of attachment means located on the legs (24, 26) of the anchor (20).

12 Claims, 2 Drawing Sheets

ROOF MOUNTABLE SAFETY LINE ANCHOR

TECHNICAL FIELD

This invention relates generally to safety equipment for ensuring the safety of workers working on or near a roof. More particularly, the present invention relates to a device for safe guarding against a worker having a hazardous fall when working on or near a peaked roof.

BACKGROUND OF THE INVENTION

Workman must work on or near a roof to install roofing, perform repair work, pressure wash a roof, repair a chimney, or repair other vents or structures located on or near the roof. When working on or near roof, a worker is exposed to dangerous falls.

The dangers of falls from such high structures has been recognized by many state industries and labor laws, some of which require that a worker on a roof or wall more than a specified distance above ground be securely tied off. For example, the state of Washington requires that a worker be tied off by an anchored line which can carry 5,000 pounds of load. Properly anchored lines are particularly difficult to provide in residential construction.

Often, a worker on a roof utilizes a safety line, which has an anchored end and an end attached to the worker. One method which has been used for anchoring a safety line when working on one side of a peaked roof, has been for the worker to throw one end of the safety line across the peak of the roof and down the other side. The end of the safety line is then anchored to a large tree or truck bumper on the ground and the other end is tied to the worker. The worker may then work on the one side of the roof with the safety line preventing accidental falls. Unfortunately, this system has drawbacks. For example, the worker is limited to working on only the one side of the peaked roof. In addition, if a worker ties off his safety line to a tree while installing roofing, the worker may find that the tree has been removed when he returns to repair the roof. Likewise, if a worker ties off this safety line to a truck bumper while roofing, at a later time, changes in the landscape may prevent the worker from parking a truck. Such changes in the landscape would often occur during construction.

Some workers may choose to tie directly to the roof structure or to use an anchor, such as an eyebolt or the like. This is unacceptable for two reasons. First, tieing a knot around a rafter or roof batten board does not ensure that it is properly anchored. Likewise, using an eyebolt or similar anchor does not ensure that the required load can be carried, due to the unknown variables of each structure and the method of installation of any such device. Second, this type of attachment requires that it be removed prior to completion of the roofing project, exposing the worker to a temporary risk and not being available at all when a worker returns for repair or maintenance.

SUMMARY OF THE INVENTION

The present invention provides a safety line anchor mountable on a peaked roof. The safety line anchor comprises first and second legs which extend outwardly to opposite free ends from a central point where the legs are integrally joined. Attachment means are located on each leg, adjacent the central point. A safety line connection point is located at the free end of each leg. In use, the anchor is positioned at the peak of the roof such that each leg extends along a separate pitch of the roof and the angle between the legs approximates the angle between the roof pitches on each side of the roof peak. The attachment means may include apertures through which lag screws mount the anchor to the roof. Each safety line connection point may include an eyelet.

In another form of the invention, each leg of the anchor includes a bent up portion where the safety line connection point is located. The bent up portion is angled relative to the leg such that upon installation, the portion extends outwardly from the roof.

In another form of the invention, the legs of the anchor are furnished in a configuration in which the legs are at only a slight angle relative to one another. During installation, the anchor is bent to conform to the relative angles of the pitches on either side of the roof peak.

In still another form of the invention, each leg is dimensioned such that roofing material may be placed below an outward portion of each leg and over an inward portion of each leg, including the central point and the attachment means.

Other aspects and features of the present invention will be noted upon examination of the drawings, description of the best mode for carrying out the invention, and claims, all of which constitute disclosure of the present invention.

BRIEF DESCRIPTION OF THE DRAWINGS

Like reference numerals are used to designate like parts throughout the several views of the drawing, and.

BEST MODE FOR CARRYING OUT THE INVENTION

Figure 1:
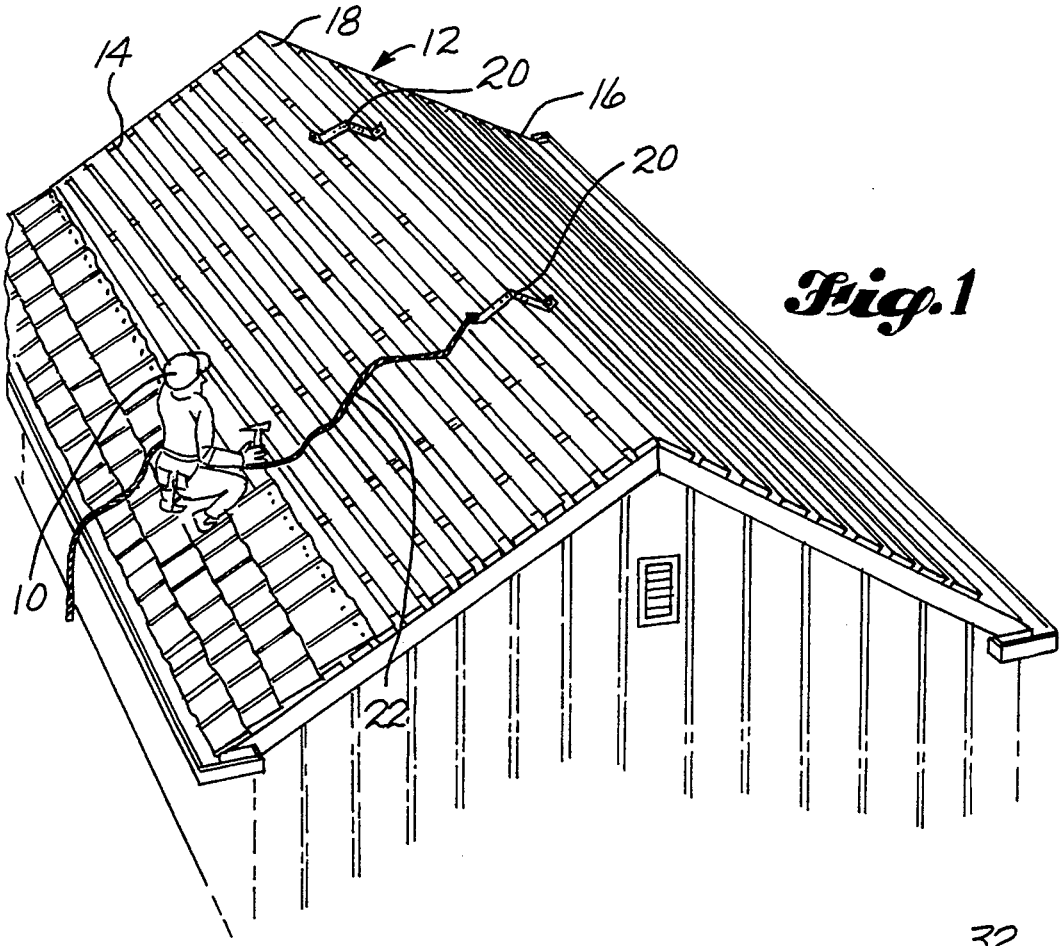
FIG. 1 is a pictorial view of a roof which has two of the present invention safety line anchors installed.

Referring to the various figures of the drawings, and first to FIG. 1, therein is shown a worker 10 on a peaked roof 12. The peaked roof 12 has a first pitch 14, a second pitch 16, and a peak 18. Two safety line anchors 20, according to the present invention, are installed on the roof 12. The safety line anchors 20 are mounted on the roof 12 such that each anchor 20 spans the peak 18 and extends down the first pitch 14 and the second pitch 16. A safety line 22 extends between and is attached to both the safety line anchor 20 and the worker 10.

Figure 2:
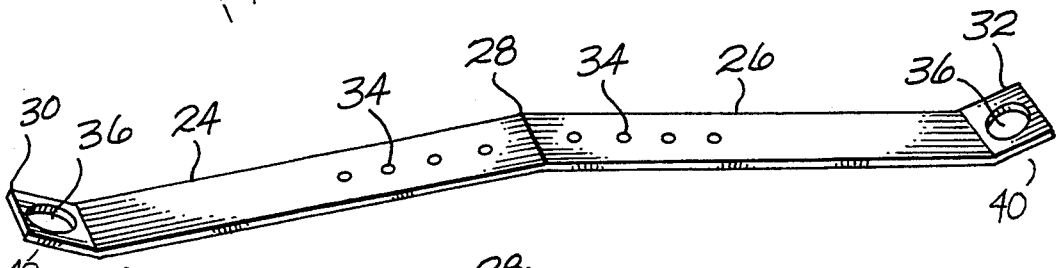
FIG. 2 is a pictorial view of the safety line anchor.
Figure 3:
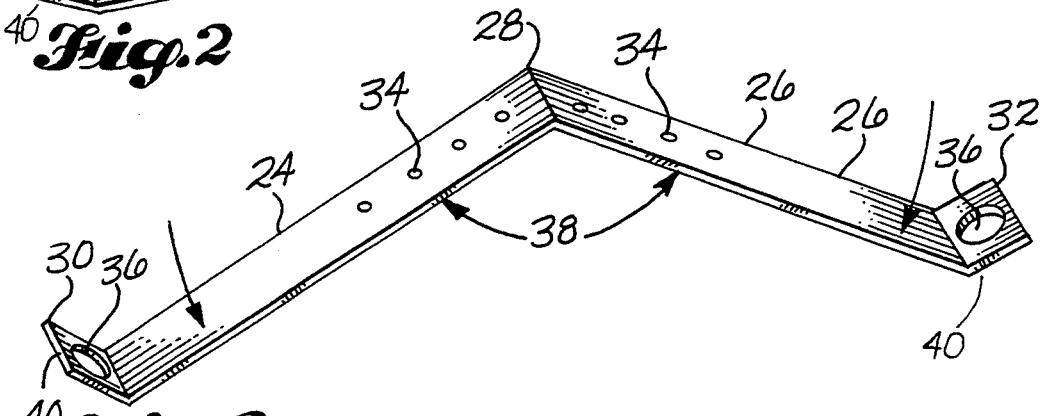
FIG. 3 is a pictorial view of the safety line anchor in its use position.

The safety line anchor 20 has a first leg 24 and a second leg 26, as illustrated in FIGS. 2 and 3. The legs 24, 26 are joined at a central point 28. Each leg 24, 26 has a free end 30, 32; respectively. Attachment means 34 are provided on each leg 24, 26. A safety line connection point 36 is provided at each of the free ends 30, 32.

Before installation, the safety line anchor 20 may be in a relatively flat configuration with the legs 24, 26 at only a slight angle relative to each other, as illustrated in FIG. 2. In the flat configuration, the anchor 20 is slightly bent at the central point 28. Before or at the time of installation, the anchor 20 is further bent about the central point 28, as illustrated by the arrows in FIG.

3, such that the angle 38 between the legs 24, 26 approximates the angle between pitches 14, 16 of the roof 12.

The safety line connection points 36 are provided on the anchor 20 such that a safety line 22 may be secured to the anchor 20. The connection points 36 may be integral with or separately attached to the legs 24, 26. The connection points 36 may be in the form of eyelets, as illustrated in FIGS. 2 and 3. In addition, the connection points 36 may be hooks, loops, or any other type of fastening device which would permit the securing of a safety line 22 to the anchor 20.

Figure 4:
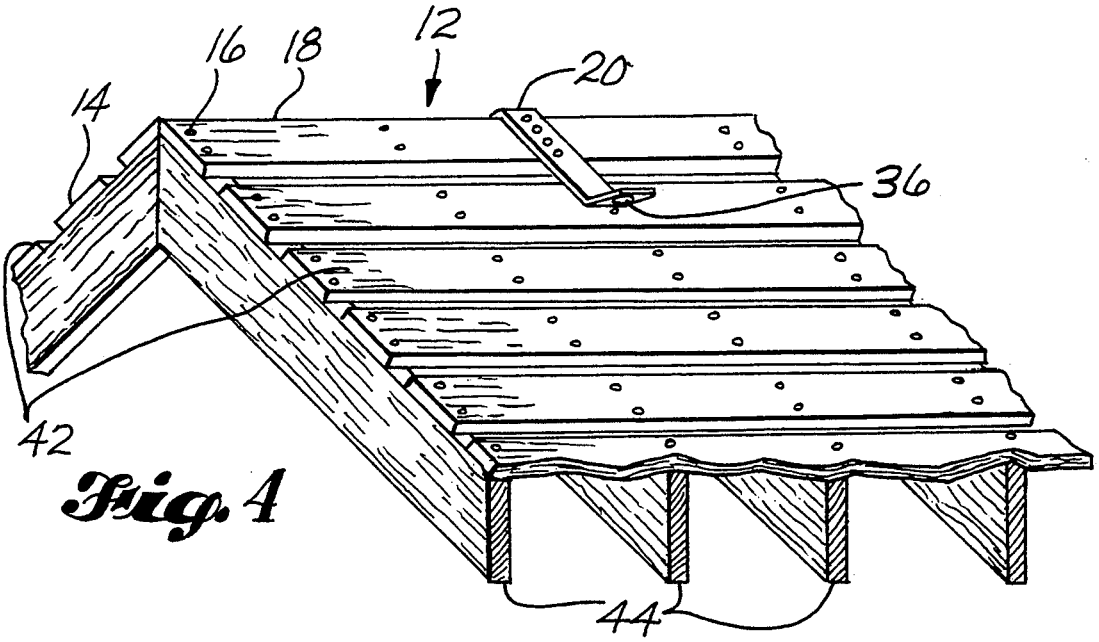
FIG. 4 is a detail view of a roof which has the safety line anchor installed.
Figure 5:
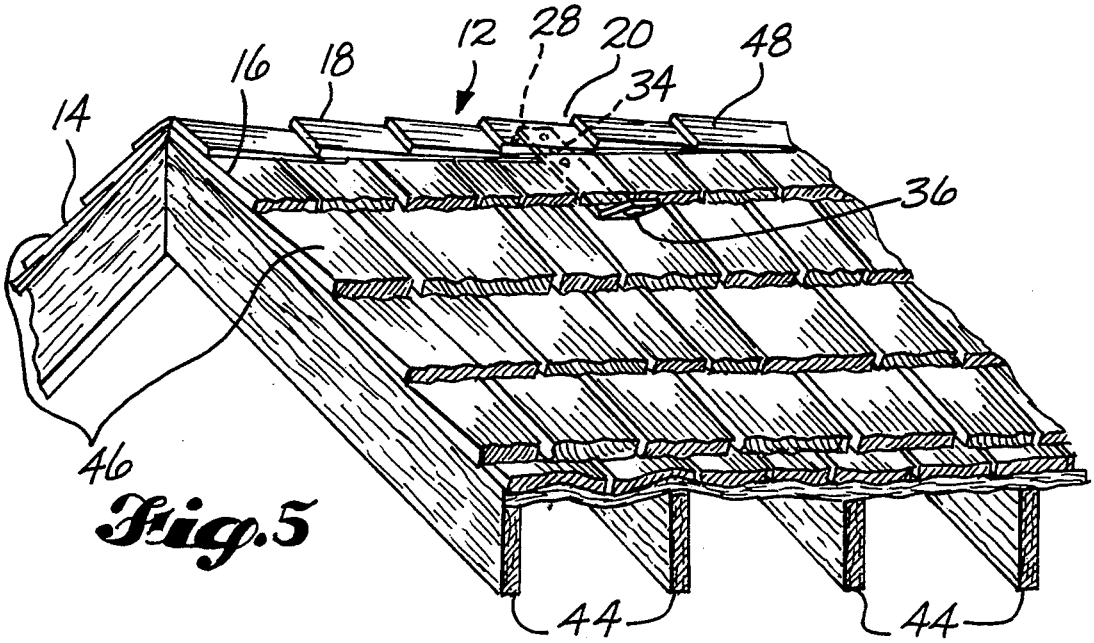
FIG. 5 is a detail view of the safety line anchor shown in FIG. 4, with part of the leg of the anchor shown in phantom which has been roofed over.

As illustrated in FIGS. 2 and 3, the connection points 36 may be on bent up portions 40 of the legs 24, 26. Each of the bent up portions 40 are angled relative to the rest of the leg 24, 26. After installation, the bent up portions 40 extend outwardly from the roof 12, as illustrated in FIGS. 4 and 5. The bent up portions 40 permit a safety line 22 to be easily secured through the connection point 36 after the anchor 20 is installed on the roof 12.

The attachment means 34 provided on the legs 24, 26 are for attaching the anchor 20 to the roof 12. The attachment means may be apertures, as illustrated in FIGS. 2–4. Further, the attachment means 34 may include multiple apertures, eyelets, or any other suitable means on the anchor 20 for securely attaching the anchor 20 to the roof 12. In preferred form, lag screws are used to attach the anchor 20 to the roof 12 by inserting the lag screws through the attachment means in the form of apertures. There may be one lag screw securing each leg 24, 26 to the roof 12. Preferably, there are at least two lag screws securing each leg 24, 26 to the roof 12. A suitable number, size and length may be selected in order to comply with bad requirements set by local regulations.

In preferred form, the anchor 20 is mounted over a roof sheathing 42, as illustrated in FIG. 4. The roof sheathing 42 may be in the form of boards or sheets of material attached to rafters 44 of the roof 12. In FIG. 4, the sheathing 42 comprises boards attached to the rafters 44. Preferably, the anchor 20 is attached through the roof sheathing 42 over a rafter 44, as illustrated in FIG. 4, to provide a secure attachment of the anchor 20 to the roof 12.

Normally, a roofing or roof cladding 46 is installed over the sheathing 42. The roofing 46 may be in the form of shake or asphalt shingles, slate, or tile. The roofing 46 may include a ridgecap 48 installed along the peak 18 of the roof. The roofing 46 and the ridgecap 48 are preferably installed such that the connection points 36 of the anchor 20 remain easily accessible by a user.

As illustrated in FIG. 5, the attachment means 34 are provided on the upper portion of the leg of the anchor 20 such that the lower portion of the legs may be lifted for installing roofing underneath or below an outward portion of the leg of the anchor 20. Further, roofing 46 may be installed over the upper or inward portion of the legs of the anchor 20 and over the central portion 28 of the anchor 20. In this configuration, the worker 10 may be securely tied off to the anchor 20 while installing roofing 46, yet the anchor 20 would not interfere with the roofing installation. Preferably, the legs 24, 26 are about the length of one exposed row of roofing 46. As illustrated in FIG. 5, the legs are about the length of one row of installed shake shingles, including the ridgecap 48.

The anchor 20 provides a means for a worker 10 to attach a safety line 22 securely at the roof line while working on the roof. In preferred form, enough slack is provided in the safety line 22 such that the worker 10 may access different portions of the roof 12, while still preventing the worker 10 from falling a hazardous distance.

The anchor 20 should be constructed from a durable, corrosion resistant, load bearing material such that its integrity would not be adversely affected after exposure to sun, wind, and moisture. The anchor 20 should be able to withstand the load exerted by a worker falling while attached to the safety line. In preferred form, the anchor 20 should be able to bear 5,000 pounds of load. The anchor may be formed of any material or combination of materials which is capable of withstanding the weather and loading forces required. In preferred form, the anchor is constructed of stainless steel. Also, in preferred form, the anchor 20 is about $\frac{1}{4}$ of an inch in thickness, and the legs 24, 26 are about two inches wide.

Once installed upon a roof, the anchor 20 provides an exposed, accessible, and secure connection points for a worker on the roof. It is contemplated that the anchor 20 would be installed permanently on the roof. Preferably, the anchor 20 is installed on a roof 12 during the construction of a building or during replacement of the roofing. After the roofing 46 has been installed, the anchor 20 may later be used by a worker cleaning or replacing the roof, the gutters, the vents, or the chimneys located on or near the roof. The anchor 20 may be installed at any other time, but this would not be preferred since roofing would have to be removed and reinstalled to allow for the installation of the anchor. On a large building or home, more than one anchor 20 may be installed to allow for access to all of the portions of the roof.

The anchor 20 is particularly useful for residential construction. Often, the lack of safe connection points in residential construction exposes workers and homeowners to hazardous falls. By installing the anchor 20, roofing, cleaning, and maintenance may be performed by a homeowner or worker with a secured safety line.

The embodiment shown is that which is presently preferred by the inventor. Many variations in the construction or implementation of this invention can be made without substantially departing from the spirit and scope of the invention. For this reason, the embodiment illustrated and described above is not to be considered limitive, but illustrative only. The scope of my patent rights are to be limited only by the following claim or claims interpreted according to accepted doctrines of claim interpretation, including the doctrine of equivalents.

What is claimed is:

1. A roof safety system for securing a safety line to a roof, comprising:

a roof having a peak formed by a first pitch and a second pitch;

an anchor attached to said roof, said anchor comprising first and second legs each extending outwardly to opposite free ends from a central point at which said legs are integrally joined, attachment means on each said leg adjacent said central point, and a safety line connection point at said free end of each of said legs, said anchor being attached such that said first leg extends along said first pitch of said roof and said second leg extends along said second pitch of said roof and said angle between said first and second legs approximates the angle between the roof pitches on either side of said roof peak.

2. The roof safety system of claim 1, wherein said attachment means include an aperture and said system further includes a lag screw received in said aperture and in said roof mounting said anchor to said roof.

3. The roof safety system of claim 1, wherein said anchor is composed substantially of stainless steel.

4. The roof safety system of claim 1, wherein said safety line connection point includes an eyelet, and wherein in use, a safety line is threaded through said eyelet.

5. The roof safety system of claim 1, wherein each said leg includes a bent up portion at each said free end, said safety line connection point being located on said bent up portion, and said bent up portion being angled relative to said leg such that said bent up portion extends outwardly from said roof pitch.

6. The roof safety system of claim 1, wherein each said leg is dimensioned such that roof material may be placed below an outward portion of each leg and over an inward portion of each leg, said inward portion including said attachment means.

7. A method for providing a roof with a roof safety system, said roof having a peak formed by a first pitch and a second pitch comprising;

providing an anchor, said anchor comprising first and second legs each extending outwardly to opposite free ends from a central point at which said legs are integrally joined, attachment means on each said leg adjacent said central point, and a safety line connection point at said free end of each of said legs;

positioning said anchor on a peaked roof such that said first leg extends along a first pitch of said peaked roof and said second leg extends along a second pitch of said peaked roof;

securing said first leg to said first pitch; and securing said second leg to said second pitch.

8. The method of claim 7, wherein said method further includes bending said anchor such that said angle between said first leg and said second leg substantially conforms with the angle between the first pitch and the second pitch of said peaked roof before said anchor is secured to said roof.

9. The method of claim 7, wherein said method further includes securing a safety line through said safety line connection point.

10. The method of claim 7, wherein said method further includes forming a bent up portion of a leg of said anchor by bending an end portion of the leg such that said end portion extends outwardly from said roof, said bent up portion including said safety line connection point.

11. The method of claim 9, wherein said method further includes forming a bent up portion of a leg of said anchor by bending an end portion of the leg such that said end portion extends outwardly from said roof, said bent up portion including said safety line connection point.

12. The method of claim 7, wherein said attachment means includes an aperture, and said method further includes providing a lag screw, inserting said lag screw into said aperture, and securing said anchor to said roof by screwing said lag screw into said roof.

* * * * *